United States Patent [19]

Rhodes

[11] Patent Number: 4,462,065

[45] Date of Patent: Jul. 24, 1984

[54] APPARATUS FOR DECORATIVELY LIGHTING AN OUTDOOR TREE

[75] Inventor: Robert E. Rhodes, Denver, Colo.

[73] Assignee: Evergreen Specialty Company, Denver, Colo.

[21] Appl. No.: 510,653

[22] Filed: Jul. 5, 1983

[51] Int. Cl.[3] ..... F21V 21/32; F21P 1/02

[52] U.S. Cl. ..... 362/250; 362/252; 362/123; 362/396; 362/419; 362/430; 362/431; 362/806; 339/157 C

[58] Field of Search ..... 362/123, 249, 250, 252, 362/251, 396, 430, 431, 806, 419; 339/157 C

[56] References Cited

U.S. PATENT DOCUMENTS

| | | | |
|---|---|---|---|
| 1,806,773 | 5/1931 | Waters | 362/249 X |
| 2,802,095 | 8/1957 | Denning et al. | 362/123 X |
| 2,857,506 | 10/1958 | Minteer | 428/18 X |
| 2,922,031 | 1/1960 | Stiffel | 362/431 |
| 3,019,357 | 1/1962 | Zaffina | 339/157 C |
| 3,321,730 | 5/1967 | Schlangen | 362/396 X |

*Primary Examiner*—Donald G. Kelly

*Assistant Examiner*—John S. Maples

*Attorney, Agent, or Firm*—Klaas & Law

[57] ABSTRACT

An apparatus and method for decoratively lighting an outdoor tree, the apparatus comprising an elongate tubular member adjustably mounted on the trunk portion of a tree by tree mounting brackets, the elongate tubular member having a light branch receiving bracket mounted at the upper end thereof which removeably receives a plurality of light branches therein in non-rotating relationship therewith, each lighting branches being constructed from an elongate rod member having an electric cord extending therealong with a plurality of light sockets attached thereto with electric bulbs received therein, the electric cord being secured to the rod with tubular conduit and adhesive wrap, each light branch exterior surface being coated with a high strength coating material having glitter therein, each branch electric cord being removeably connected to a central electric cord within the tubular member, the light branches being positioned within the branch area of a tree to provide a lighting pattern therein.

1 Claim, 6 Drawing Figures

APPARATUS FOR DECORATIVELY LIGHTING AN OUTDOOR TREE

BACKGROUND OF THE INVENTION

The present invention relates generally to outdoor tree lighting and decoration and, more particularly to a decorative tree lighting apparatus attachable to a trunk portion of a natural tree and which provides a predetermined lighting pattern within the branch portion of the natural tree without physical attachment of the lighting apparatus to the tree branch portion.

A number of devices have been provided in the past for simulating the appearance of a Christmas tree or other lighted tree.

Ekdahl, U.S. Pat. No. 1,613,386 discloses a device consisting of a base which supports a continuous, tubular, tapered, sheet metal trunk. The diameter of the trunk gradually decreases from the lower to the upper end and thereby frictionally supports a plurality of sleeves of different internal diameter. A plurality of branches each composed of an elongate sheet metal strip bent to form a vertically arranged shank portion are soldered to each sleeve. Each sleeve and the branches attached thereto constitute a unit which is removable from the trunk. An electric lamp socket adapted to support a bulb is positioned at the end of each branch and insulated conducting wires are positioned along the branch and secured thereto.

Denning et al, U.S. Pat. No. 2,802,095 discloses a Christmas tree lighting bracket unit which is secured to a laterally extending branch of a natural fir tree to provide rigidity to the branch. The bracket is provided with decorative lights along the length thereof. The bracket unit comprising an elongate body formed of metal or rigid plastic having longitudinally extending grooves in its upper side which seat an insulated current carrying conductor. At spaced intervals along the length of the body are mounted sockets which include connectors in electrical contact with conductors and which removably seat light bulbs. The bracket body is enclosed along its full length, except immediately adjacent the sockets, by an insulating covering. The covering ends immediately adjacent opposite sides of a light socket, each socket being protected by its own insulation wrapping which encircles the adjacent portion of the bracket body and also the exterior of the socket itself. An electrical connector member is provided at the inner end of each bracket unit. The connector member is adapted to receive current from a conductor having a mating connector portion. The bracket is supported on the branch by flexible metal straps. The branch and bracket are supported in brace fashion by connector straps attached to the trunk of the tree and to the bracket.

Minteer, U.S. Pat. No. 2,857,506 discloses an illuminated artificial tree having a hollow tubular trunk affixed to a block. The block is mounted rotatably on a vertical spindle fixed in a circular floor engaging base. A plurality of tubular socket members are fixedly attached to the trunk of the tree in a laterally extending direction. Each socket carries a branch of the tree. Some of the branches comprise a strand of bendable non-resilient material secured in one of the sockets having a pliable electric cable laid therealong and a pliable tubular sheath of electrical insulating material enclosing the strand and cable. The sheath is exposed at various portions therealong to expose electric light bulb sockets carrying electric light bulb. The inner end portion of the electric cable passes into the trunk through a hole formed in the trunk adjacent a corresponding socket. Each electric cable is connected by an electric fitting to another electric cable passing longitudinally through the trunk. Adjacent the lower end of the trunk the second cable emerges from the trunk through an insulating eyelet and is adapted to be connected with a suitable power source.

Eckert, U.S. Pat. No. 3,296,430 discloses an artificial tree having a tapered trunk having a multiplicity of inwardly and downwardly inclined bores or sockets therein. The sockets receive the inner end portions of removable upwardly and inwardly inclined branches. A plurality of inverted conical brackets are mounted about the trunk of the tree. Pockets are formed by each inverted conical bracket. Connector wires electrically connect light sockets mounted on the branches in parallel. A conductor cord receives plugs from the conductor wire at a position outside the tree trunk.

Lu, U.S. Pat. No. 3,603,780 discloses a structure for an artificial tree having a hollow trunk with hollow sleeve limbs pivotally mounted on the trunk at decreasing distances therefrom toward the tree top for folding of the structure into a minimized volume. Electrical wiring extending from limbs through the tree trunk provide an integral lighting system.

Fisher, U.S. Pat. No. 3,617,732 discloses an artificial tree having a support base, a trunk member removably connected to the base with a threaded flange, a plurality of limb members connected to the trunk member, a plurality of electrical lights secured to the end of each limb member and electrically connected to power supply regulated with voltage reduction means connected to the tree's base. The interiors of the trunk member and limb members are hollow and communicate through coupling members. Electrical conductors are strung through the trunk member and connect with conductors in the limb members. The tree base contains rotation means.

Smith, U.S. Pat. No. 3,970,834 discloses an artificial tree having a base which receives a tree center shaft therein. A plurality of pivotal branches are mounted on a plurality of slip collars positioned in spaced apart relationship and connected by a connector bar. A lever connected to the center shaft and connector bar causes pivotal movement of the branches allowing them to be folded into a small space. The tree branches and tree center shaft are hollow and have wires running therethrough which are connected to lights mounted on the tree branches. The wires in the various branches are connected in parallel to a central wire in the tree shaft. The wires to the branches pass through small openings provided in the tree shaft.

Miller, U.S. Pat. No. 4,020,201 discloses an artificial tree including two hollow trunk members sleeved together and having a plurality of apertures angularly formed at spaced intervals in and around the trunk members for receiving cylindrical limb sockets therein. Artificial limbs having branches are sleeved within each of the apertures and simulated the branches of a tree. Further apertures for receiving tubular female electrical connectors. Spring members positioned within the tubular members urge the female connectors outwardly through an associated orifice allowing individual strings of miniature lights to be plugged into the female connectors and thereafter wound over the limbs and branches adjacent to the respective connectors. Each female connector is connected at a space to a main double conductor wire extending through the trunk members. A male socket is provided at the lower end of the conductor wire and mounted in an opening at the lower end of the tubular members for connection to a current source.

DeVicaris, U.S. Pat. No. 4,072,857 discloses an artificial tree which comprises a base, an artificial trunk connected to the base and having a first electrical conductor extending therewithin and having a first connector electrically connected to the first electrical conductor, the first connector extending through an outside wall of the trunk and an artificial limb having a second electrical conductor extending therewithin and a second connector electrically connected to the second electrical conductor. The first connector is a first female-type electrical connector which comprises first narrow slits, and the second connector is a first male-type electrical connector comprising first narrow prongs corresponding in shape to the slits such that the limb can be detachably and electrically connected to the trunk. The male-type electrical connector including an auxiliary structural support and the female-type electrical connector includes a corresponding auxiliary opening into which the structural support can be inserted.

Clamage, U.S. Pat. No. 4,142,012 discloses a tree simulative display which includes a metal stand having a vertical standard and plural tiers each carrying plural conical branch holders on a ring, the tiers being secured to the standard spaced along the length thereof. Preserved natural foliage branches are seated in each of the holders. The tier of branch holders is formed by arranging plural holders in a plural trident like array, three on a metal stem, the stems weldably secured to metal rings about the inner circumference thereof. Alternately, a secondary support ring is weldably secured to each tier about the stems and between the holders and the associated ring. The display at its top has single holders carried by a ring secured to the upper end of the standard.

Gauthier et al, U.S Pat. No. 4,161,768 discloses an electrically lit artificial Christmas tree which is assembled from separate components consisting of a central stalk, a base which supports the stalk, and main branches which have secondary branches attached to them. The branches which are made of two stiff, intertwisted and insulated electrical wires are attached to the central stalk by inserting their ends into holes provided in the stalk. This arrangement also connects the branches electrically to electrical conductors provided within the stalk; which are in turn powered by an electric cord leading from the conductors in the stalk to an electrical wall outlet. The branches have Christmas tree decorative electric globes attached to them, and are trimmed with artificial pine needles.

It has been a common practice for many years to decorate outdoor evergreen trees with electrical lights similar to the lights used on indoor Christmas trees. In recent years it has become fashionable, especially in urban business and commercial areas, to decorate disiduous trees with strings of lights attached to the tree branches. The latter form of tree decoration is also generally seasonal and requires the periodic attachment and removal of lights from the trees. In order to provide a tasteful display, commercial decorators have found it necessary to spend a considerable amount of time attaching light string electric wires at closely spaced intervals to associated tree branches to prevent an unaesthetic appearance which would be created by tangled or drooping electrical wires within the tree branches. The removal of such lighting strings is equally time consuming and, in many cases the decorators simply leave the lights in the trees rather than go through the time consuming process of light string removal.

It would be generally desirable to provide decorative lighting apparatus for outdoor trees which would provide an attractive lighting pattern within the tree branch portion and which could be quickly erected or removed from the tree by unskilled workers.

SUMMARY OF THE INVENTION

The present invention comprises an apparatus and method for decoratively lighting a natural outdoor tree. The apparatus comprises an elongate tubular member which is attached in a generally vertical orientation to the trunk portion of a tree by at least one adjustable bracket. The bracket comprises a spacer which allows the elongate tubular member to be positioned at a predetermined distance from the tree. The adjustable bracket also comprises a tree mounting sleeve which is attachable over a circular padding member to prevent injury to the tree. A plurality of lighting branches are mounted on an upper portion of the elongate tubular member and provide a predetermined lighting configuration in the branch area of the associated tree. Each lighting branch comprises a central elongate rod which provides structural support for the associated lighting branch. The rod is connected by a connector portion at one end to a branch mounting bracket attached to the upper end of the elongate tubular member. The remainder of the rod is not attached to any supporting structure. In the preferred embodiment, each rod has a generally inverted J-shaped configuration. Each elongate rod has associated with it a branch electric cord which runs from the free end of an associated rod to a point thereon near the point of connection of the rod to the branch bracket. Each such branch electric cord further comprises a tail portion which extends beyond the associated rod and which is connectable to another electrical cord, positioned within the elongate tubular member, by mating electrical sockets. The electrical cord positioned within the elongate tubular member is slideable therein and may be pulled through an opening in the upper end thereof to allow staggered female sockets on that electrical cord to be attached to male sockets provided on the plurality of branch electrical cords at a position outside the tubular member. The electrical cords thus connected may be drawn into the elongate tubular member to shield the connected portions from the weather and to provide the apparatus with an attractive external appearance. A plurality of branch electrical sockets are operably mounted in spaced apart relationship along the length of each branch electrical cord. In a preferred embodiment, both the electrical cord and the electrical sockets have a flat bottom surface which is positioned in engaging contact with the outer surface of each branch rod member. A low wattage electric light bulb in operably positioned in each electrical socket. The connection of the sockets to the branch wire are in parallel, thus the loss of a single light bulb will not cause an entire light string to loose electrical current. A fuse may be provided in the tail portion of each branch electric cord or an associated portion of the central connecting cord to interrupt the current to an associated branch in response to a current overload. A plurality of flexible conduit members, each having a longitudinal slit running from end to end thereof, are provided to enclosingly receive an associated portion of a branch electrical cord and branch rod extending between two adjacent electrical sockets. The conduit members are positioned between every such pair of electrical sockets along the length of each branch and are secured therearound by a strand of wrapping material such as insulating tape. The length of each flexible conduit member is substantially the same length as the distance between associated pairs of socket members. A coating material such as vinyl which is preferrably provided with a glitter material therein is applied to coat the surface portions of the flexible conduit members and the exposed portions of the rod and electric cord members and the exterior surface of each electric socket. The coating material after drying forms a hard structurally stiff light reflecting surface which provides the light branches with a continuous uniform light reflective appearance. The lighting branches may be mounted by a branch mounting bracket which comprises a sleeve portion fixedly attached to the upper end of the elongate tubular member. The sleeve portion has a plurality of branch receiving pockets positioned at the periphery thereof. In the preferred embodiment, each such branch receiving pocket comprises a cavity having a generally rectangular cross-section which is adapted to receive an end portion of each rod of similar rectangular cross-section whereby the light branches are held in non-rotatable relationship therein. In the preferred embodiment, the inverted J-shaped branches have a shank portion extending vertically upwardly from the branch receiving pockets and a hook portion curving outwardly away from the centrally positioned elongate tubular member. In the preferred embodiment a plurality of branches spaced symmetrically about the elongate tubular member is provided.

The decorative lighting apparatus may be quickly erected by first attaching the elongate tubular member to an associated tree trunk with adjustable bracket members, adjusting the bracket members to provide a desired orientation of the elongate tubular member with respect to the trunk; inserting the lighting branches into associated portions of the branch mounting bracket; connecting tail portions of the branch electrical cord to connection portions of the central electrical cord; running the central electrical cord downwardly through a top opening in the elongate tubular member and out through a lower opening in the elongate tubular member; inserting all of the connected cord portions into the elongate tubular member; and attaching a lower terminal end portion of the central cord to a suitable power supply. The apparatus may be removed by reversing the this procedure.

DETAILED DESCRIPTION

Figure 1:
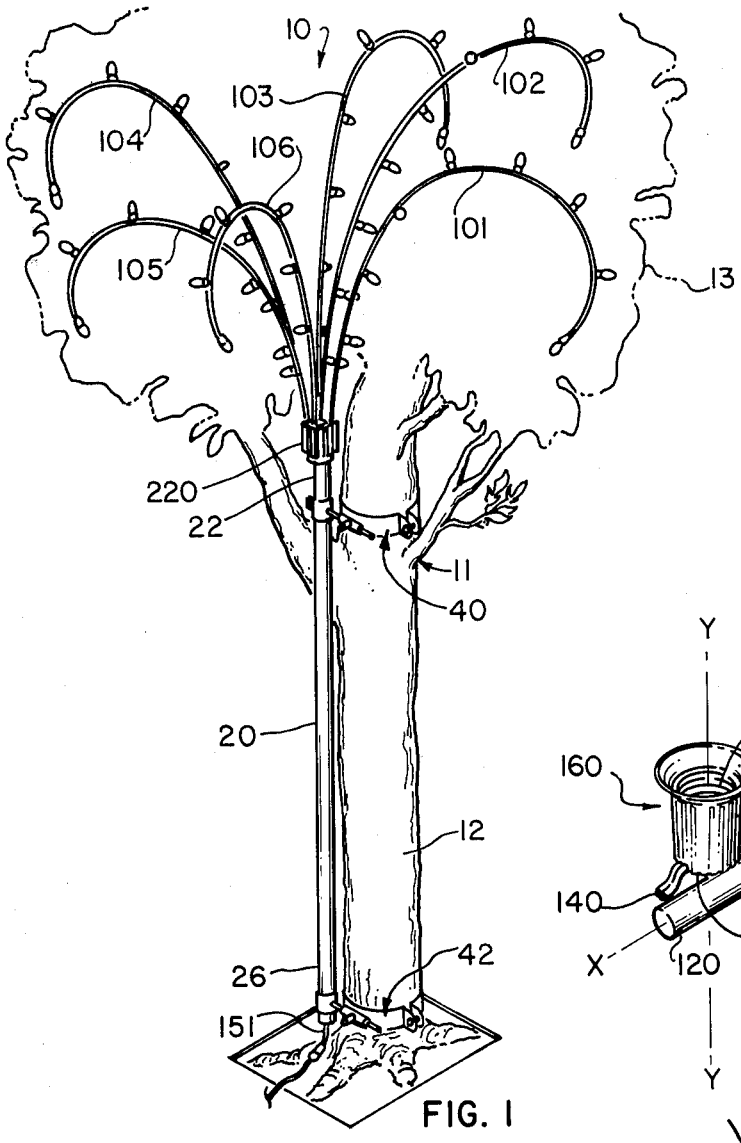
FIG. 1 is a perspective view of a decorative lighting apparatus of the present invention mounted on a natural tree.

As illustrated generally by FIG. 1, the decorative lighting apparatus 10 of the present invention comprises in general an elongate tubular means such as elongate tubular member 20 having a central electrical cord 151 therein and positionable in spaced apart relationship from the trunk portion 12 of a natural tree 11; adjustable bracket means such as brackets 40, 42 for attaching the tubular means to the tree; a plurality of lighting branch means such as lighting branches 101–106 for providing a predetermined lighting configuration within the branch area 13 of the natural tree; and branch mounting means such as branch mounting bracket 220 for removeably mounting the plurality of lighting branch means on the upper end of the elongate tubular means.

As illustrated in FIGS. 1, 2, 3, and 6, the elongate tubular means may comprise an elongate cylindrical tubular member 20 having a top end 22 with a top end opening 24, a bottom end 26 with a bottom end opening 28, and a central longitudinal cavity 30 extending between the openings. In the preferred embodiment, the elongate tubular means comprises a cylindrical PVC pipe having an internal diameter of approximately 1 inch to 3 inches and having a length sufficient to extend from the base portion of an associated tree trunk to a lower portion of the tree's branch area.

Figure 3:
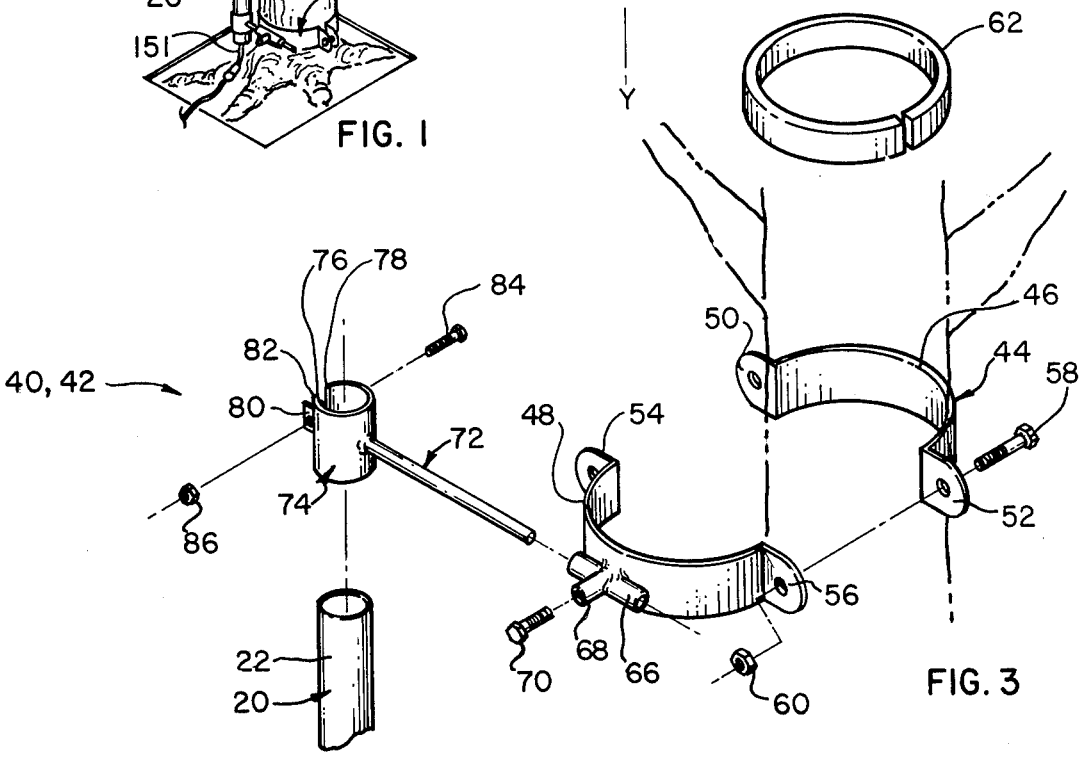
FIG. 3 is an exploded perspective view of a adjustable attachment bracket for attaching an elongate tubular member to a tree.

As illustrated by FIGS. 1 and 3, the adjustable bracket means may comprise an upper bracket 40 and a lower bracket 42. Each bracket in turn comprises a tree sleeve 44 having opposite C-shaped portions 46, 48 with radially extending wing portions 50, 52, 54, 56 positioned at the ends thereof. Each wing portion has a central bore therein which may be aligned with a bore in an opposite wing portion for receiving attachment means such as a bolt 58 and nut 60. In a preferred embodiment, a ring of padding material 62 such as cloth, cork or other relatively soft material may be provided in encompassing relationship about the tree prior to attachment of the tree sleeve 44. The padding material 62 serves as a barrier protecting the tree from damage by the relatively rigid tree sleeve 44. A relatively small, shaft accepting sleeve 66 may be fixedly attached to an outer surface of the tree sleeve 44 in substantially perpendicular relationship to the central axis of the tree sleeve as by weldement or other rigid attachment means. A perpendicular set screw sleeve 68 having a threaded cavity is provided in intersecting perpendicular relationship with the cavity of shaft sleeve 66. A set screw 70 which is operably received in the set screw sleeve cavity may be used to tighten a bracket shaft 72 which is slideably received within the shaft sleeve 66. A tubular member sleeve 74 is provided which is fixedly mountable upon the elongate tubular member 20. The tubular member sleeve may be slit longitudinally to provide a gap portion defined by opposite longitudinal edges 76, which allows the tubular member sleeve 74 to be spread apart slightly for slideable positioning along tubular member 20. Wing portions 80, 82 having coaxially positionable holes therein may be provided at the opposite longitudinal edge portions 76, 78 and may be urged together by attachment means such as bolt 84 and nut 86 to fixedly hold sleeve 74 in a fixed position on member 86. Bracket shaft 72 may be fixedly attached at one end thereof as by welding to the surface of tubular member sleeve 74 and slideably mounted at the opposite end thereof within shaft sleeve 66. This arrangement allows the engaged portion of elongate tubular member 20 to be positioned at variable distances from the tree trunk. Use of two such bracket means 42, 44 allows the elongate tubular means to be positioned in a vertically upright position even if the tree trunk deviates slightly from a vertical orientation. More than two adjustable bracket means may be required for trees having very long trunk portions. For trees having short trunk portions, a single adjustable bracket means may be sufficient. Shaft sleeve and set screw portion 66, 68 may also be conventionally pivotally mounted on tree sleeve 44 whereby sleeve 66 is pivotable about the set screw 70 axis to further facilitate adjustment and spacing of the elongate tubular member 20 relative the tree trunk 12.

Figure 4:
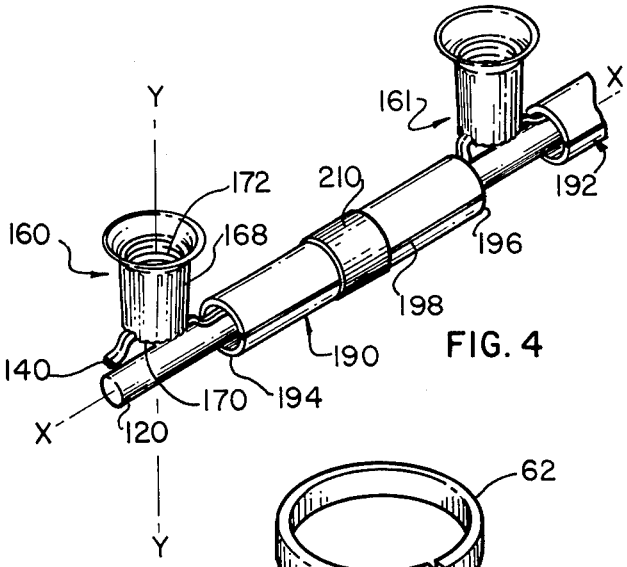
FIG. 4 is a detailed perspective view showing the arrangement of certain portions of a light branch of the decorative lighting apparatus of the present invention.
Figures 2, 5, 6:
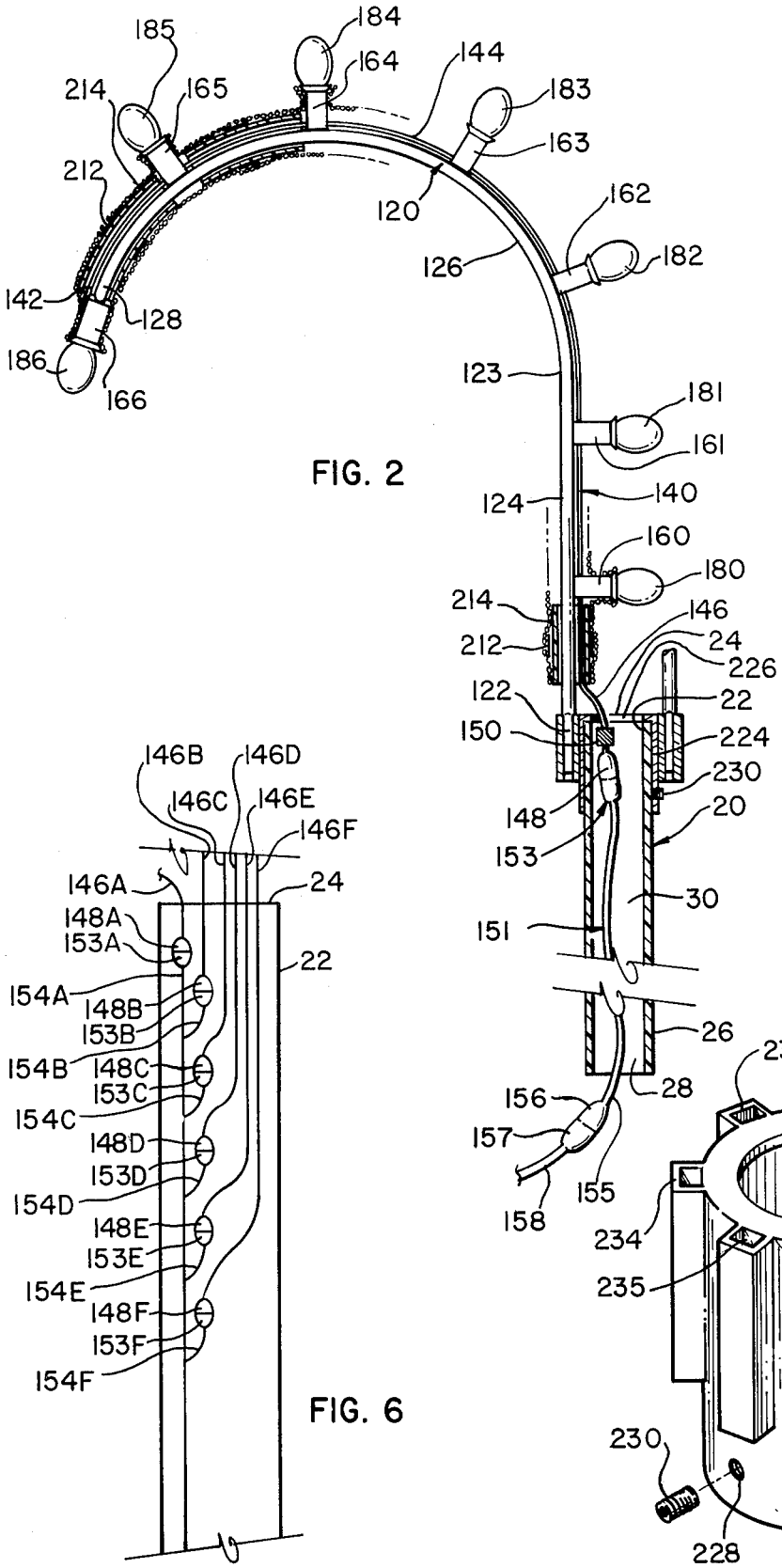
FIG. 2 is a cross-sectional elevation view of a portion of the decorative lighting apparatus of the present invention.
FIG. 5 is a perspective view of a lighting branch mounting bracket of the decorative lighting apparatus of the present invention.
FIG. 6 is a schematic cross-sectional view of a portion of an elongate tubular member and portions of connected electrical cord members of the decorative lighting apparatus of the present invention.

As illustrated by FIGS. 1, 2, and 4, lighting branch means may comprise lighting branch member 101–106 mounted at the top portion 22 of the elongate tubular member 20 to form a predetermined lighting pattern within the branch area 13 of the tree 11. Although 6 branches are provided in the preferred embodiment, smaller or greater numbers of branches may be used. As best illustrated in FIGS. 2 and 4, each lighting branch means comprises an elongate rod means such as rod 120 having, in a preferred embodiment, a connection end 122 which is mounted proximate the elongate tubular member 20; an intermediate portion 123 which comprises a relatively straight shank portion 124 and a hook portion 126 having a relatively large radius of curvature; and a free end 128. In the preferred embodiment, the branch comprises a generally circular cross-section except for the connection end 122, FIG. 5, which comprises a rectangular cross-section. The central longitudinal axis of the rod is designated as XX. Other rod shapes and thus lighting branch shapes are, of course, possible and may be employed to achieve desired aesthetic effects in various and sundry applications. The configuration of the preferred embodiment has an arched shape which provides relatively uniform load distribution along the length of the rod to prevent excessive bending of the branches such as by wind loading or the like. The arched configuration also provides a gentle curve simulating the natural curvature of tree branches. In the preferred embodiment, the elongate rod member 120 is constructed from a high strength material such as iron or steel and may have a diameter on the order of ¼ inch and a length on the order of 4 to 12 feet.

A branch electric cord means such as cord 140 shown by FIGS. 2 and 4 is positioned along the elongate rod means and in the preferred embodiment comprises a flat cord which is positioned in abutting engagement with the rod means surface. Electric cord 140 comprises a terminal end portion 142 which terminates near the free end 128 of the rod means, a intermediate portion 144 extending along the length of the rod means and a tail portion 146 extending away from the rod means at a point proximate the rod connection end 122. A terminal end male adapter 148 or other conventional electrical connection means is provided at the terminal end of tail portion 146. A fuse means 150 may be provided within the tail portion 146 to interrupt flow of electrical current at a predetermined overload amperage. The fuse means 150 may be of any conventional fuse construction well known in the art. Spaced apart branch socket means such as sockets 160–166, etc. as illustrated in FIGS. 1, 2 and 4 are provided in spaced apart relationship along the length of electric cord means 140. The socket means comprise a generally cylindrical exterior surface 168 with a flat bottom end portion 170. Electric cord 140 is threaded through opposed holes in the lower portion of the socket side wall 168, and is placed in electrical connection with a female threaded cavity portion 172 of the socket means by conventional electrical attachment means well known in the art. The flat surfaces of the cord 140 and socket bottom 170 allow the cord and socket to be placed in abutting relationship with the surface of rod means 120. Electric light means such as bulbs 180–186, etc., which in the preferred embodiment are conventional, low wattage Christmas tree type light bulbs, are matingly mounted in the threaded cavities 172 of the branch sockets 160–166, etc. Flexible conduit means such as cylindrical plastic conduit 190, 192, etc., each having a first end 194, a second end 196 and a longitudinal slit 198 running from end to end are provided between each pair of branch sockets 160–166, etc., FIG. 4. The flexible conduits 190, 192, etc. may be spread apart at the slit 198 to receive associated portions of elongate rod means 120 and branch electrical cord means 140 therein. A wrap means, such as conventional insulating tape 210, may thereafter be attached in circumscribing relationship about an associated flexible conduit means to hold it in enclosing relationship about the rod means and cord means. The internal diameter of the conduit means is of a size whereby the cord and rod are held in engaging contact by the conduit means.

A coating means such as acrylic vinyl 212 or other suitable strengthening or stiffening agent is applied to the exterior surface of each flexible conduit means and associated wrap means and also about the exterior wall surface of each branch socket means and exposed portions of branch cord means and rod means positioned between pairs of flexible conduit means. In the preferred embodiment, the coating means contains a light reflecting means such as metallic flake material, generally referred to as "glitter", which is uniformly distributed within the coating means. The coating means provides an insulative seal which prevents rain water, etc. from shorting or otherwise damaging the coated portions of the branch socket means and cord means. The coating means also helps to secure the socket means in a fixed non-moving position relative the rod means 120. The glitter material provided in combination with the coating means enhances the appearance of the branch means, creating a continuous, light reflective exterior surface. In the preferred embodiment the elongate tubular means 20 has a neutral surface color which is not visually prominent, especially at night, when the electric light bulbs 180–186, etc. are illuminated.

A tubular member electrical cord means 151 is provided which extends from an upper portion of the tubular member cavity 30 through the length of the cavity and terminates at a position outside the cavity lower end opening 28. In the preferred embodiment, illustrated by FIG. 6, the central cord 151 comprises female adapters 153A–F in longitudinally staggered positions along the length of cord 151 which operably receives male adapter portions 148A–F of associated branch cordtails 146A–F. The female adapters 153A–F are connected to the cord 151 through connector cord portions 154 radiating outwardly from the main body of cord 151 at spaced apart positions therealong. This arrangement allows branch cords 140 to be constructed from conventional and readily available electrical conduit having conventional electrical adapters and allows the electrically connected portions of the tubular member electrical cord means 151 and the branch cords 140 to be positioned within the elongate tubular member 20. This arrangement protects the cords and cord connection portions from exposure to the weather and also presents an uncluttered external appearance. A conventional male adapter 156 may be provided at a lower terminal end 155 of the tubular member electric cord means allowing it to be attached to a power supply as by a female adapter 157 of a power supply cord 158 conventionally attached to a suitable power supply (not shown).

A branch mounting means such as branch mounting bracket 220 is provided for removeably mounting light branches 101–106 at the upper end 22 of elongate tubular member 20. In a preferred embodiment, illustrated in FIGS. 2 and 5, the branch mounting means comprises a cylindrical sleeve 222 adapted to fit in close sliding relationship with the elongate tubular means 20. The sleeve comprises a cylindrical body portion 224 and a sleeve collar portion 226 provided at the upper end of the body portion extending radially inwardly therefrom and defining a circular opening 227. The lower surface of the sleeve collar portion 226 abuts with the upper edge surface at the periphery of upper opening 24 in elongate tubular member 20 thus the sleeve's downward movement thereon. A threaded hole 228 is provided in the sleeve cylindrical body portion 224 which operably receives a matingly threaded set screw 230. Set screw 230 may be conventionally screwed inwardly into abutting engagement with the elongate tubular means sidewall to prevent rotation of the branch mounting means with respect to the elongate tubular means. Branch receiving means such as pockets 231–236 are provided in equally spaced relationship about the periphery of the cylindrical body portion 224 and receive a connector portion 122 of each branch means in slidingly removeable, non-rotatable relationship therein. In the preferred embodiment, the branch receiving pockets each comprise an elongate box-like configuration having an elongate cavity 240 therein. Each elongate cavity 240 has a generally rectangular cross-section adapted to accept the rectangular connector end portion 122 of each rod means. This arrangement allows light branch means of different sizes and shapes to be removeably mounted in the branch mounting means 220 enabling the apparatus 10 to be adapted for different applications by merely providing different branch configurations.

The decorative lighting apparatus 10 of the present invention as above described has the particular advantage of being easily assembled by unskilled personnel. To erect the device, a worker completes the following steps:

1. Attach the branch mounting bracket 220 to the upper end 22 of elongate tubular means 20.

2. Attach adjustable brackets 40, 42 to the elongate tubular member 20 and to tree trunk 12 interposing padding 60 between the tree trunk and associated bracket portions.

3. Adjust the adjustable brackets to position the elongate tubular member 20 in a vertical orientation at a desired spaced apart position relative the tree trunk 12.

4. Place the connector end portion 122 of each lighting branch member 101–106 into an associated branch receiving pocket 231–236 on branch mounting bracket 220.

5. Attach female connector portions 154A–F of tubular member electric cord 151 to male adapter portion 148A–F of associated branch cords 140A–F.

6. Place the tubular member electric cord 151 and connected adapters 148A–F, 154A–F into tubular member cavity 30 through openings 238 and 24 by inserting terminal end male adapter 156 first, allowing gravity to draw cord 151 downwardly until male socket 156 protrudes from tubular member lower end opening 28.

7. Connect elongate tubular member electric cord 151 terminal male socket 156 to an electric power supply.

The tree branch portion of the tree to be decorated may be of a configuration which interferes with the insertion of light branches into mounting bracket 220. The additional step of rotatably adjusting the branch mounting bracket 220 on the elongate tubular member 20 may thus be appropriate before step 4. The removability of the lighting branches provide the particular advantage that the lighting branches may be inserted after the elongate member is erected, allowing workers to position the lighting branches in non-interfering relationship with the tree branches, one lighting branch at a time. The lighting branches possess a degree of resiliency which facilitates this placement within the tree branches. Of course, if a particular portion of the branch area of a tree is too dense, the lighting branch which would ordinarily occupy that position may simply be omitted or a lighting branch having a specially adapted size or configuration may be used in its place.

The decorative lighting apparatus 10 may be removed from a tree by reversing the above steps. Thus it can been seen that an attractive tree lighting apparatus is provided which may be erected or disassembled quickly and easily by unskilled workers. The apparatus is thus ideal for seasonal usage and may be used without damage to associated trees.

It is contemplated that the inventive concepts herein described may be variously otherwise embodied and it is intended that the appended claims be construed to include alternative embodiments of the invention except insofar as limited by the prior art.

I claim:

1. A decorative lighting apparatus for lighting a natural outdoor tree, comprising:

a. elongate tubular means for shieldingly receiving a central electric cord means therein and for supporting other components of the lighting apparatus thereon, said elongate tubular means having a top end with a top end opening therein, a bottom end with a bottom end opening therein, and an elongate continuous cavity extending between said top end and said bottom end openings;

b. at least one adjustable bracket means for attaching said elongate tubular means in predetermined spaced relationship to a trunk portion of the tree to be lighted, said adjustable bracket means comprising:

tree sleeve means for attachment about a peripheral trunk portion of the tree;

tubular means sleeve means for attachment about a peripheral portion of said elongate tubular means;

bracket spacer means attached in selectively variable length relationship between said tree sleeve means and said tubular means sleeve means whereby said tubular means is positionable at a preselectable distance from said tree;

c. a plurality of lighting branch means for providing a predetermined lighting configuration in the branch area of the tree to be lighted, each said lighting branch means comprising:

elongate rod means for providing structural support for said lighting branch means, said elongate rod means comprising a connection end and a free end and having a central longitudinal axis extending therebetween, said elongate rod means being constructed from a high strength relatively rigid material;

branch electric cord means for conducting electricity therethrough having a terminal end portion positioned proximate said free end of said elongate rod means, an intermediate portion extending along the length of said rod means; a tail portion extendable in spaced apart relationship from said rod means connection end in non-touching relationship with said rod means, and a terminal socket portion positioned at a terminal end at said tail portion;

a plurality of branch socket means for receiving branch light means operably connected to said branch electric cord means and positioned in equally spaced apart relationship therealong, each branch socket means comprising a central longitudinal axis extending in substantially perpendicular relationship with an associated portion of said elongate rod means central longitudinal axis;

a plurality of electric light means operably positioned in said branch socket means for providing spaced apart light sources along said branch means;

a plurality of flexible conduit means for receiving portions of said rod means and associated adjacent portions of said branch electric cord means therewithin each said conduit means adapted to extend between adjacent pairs of branch socket means in non-enclosing relationship therewith and adapted to receive associated portions of said rod means and said branch electric cord means through a longitudinal slit in a sidewall portion thereof;

wrap means for wrappingly holding said conduit means in enclosing relationship about said associated portions of said rod means and said branch electric cord means;

coating means bonded to the exterior surfaces of said wrap means, said conduit means, and said branch socket means and nonenclosed portions of said branch electric cord means and elongate rod means for providing a stiff, hard, exterior surface on said branch means for holding said socket means and said conduit means in fixed relationship with said elongate rod means and for providing an attachment medium for glitter means;

glitter means for reflecting light from said electric light means and for enhancing the appearance of said branch means;

d. branch mounting means for mounting said plurality of branch means on said elongate tubular means, said branch mounting means comprising:

a sleeve portion operably attached to a top end peripheral surface portion of said elongate tubular means proximate said upper end opening;

sleeve portion attachment means for fixedly attaching said sleeve portion to said elongate tubular means;

branch receiving means fixedly mounted in spaced apart relationship on an outer peripheral surface of said sleeve portion, said branch receiving means being adapted to receive a connector portion of an associated branch portion in selectively removeable, non-rotatable relationship therewithin;

e. tubular means electric cord means for providing electricity to said branch cord means having a plurality of tubular means cord sockets adapted to operatively mate with associated branch cord sockets said tubular means cord sockets being positioned in spaced apart relationship therealong, one above the other within said tubular means whereby said mating connection of said tubular means cord with said branch cords are enclosed within said elongate tubular means;

f. wherein said elongate tubular means is of a relatively small diameter and has a relatively non-reflective outer surface whereby said elongate tubular means is substantially less visibility prominent than said branch means when said branch light means are illuminated.

* * * * *